US006979770B2

(12) United States Patent
Hampton, Jr.

(10) Patent No.: US 6,979,770 B2
(45) Date of Patent: Dec. 27, 2005

(54) MULTI-TRIGGER ELECTRONIC DRUM PEDAL

(76) Inventor: Ronald K. Hampton, Jr., 206 S. Clinton, New Athens, IL (US) 62264

( * ) Notice: Subject to any disclaimer, the term of this patent is extended or adjusted under 35 U.S.C. 154(b) by 229 days.

(21) Appl. No.: 10/608,838

(22) Filed: Jun. 27, 2003

(65) Prior Publication Data

US 2004/0025667 A1 Feb. 12, 2004

Related U.S. Application Data

(60) Provisional application No. 60/393,625, filed on Jul. 2, 2002.

(51) Int. Cl.[7] ..... G10H 3/14
(52) U.S. Cl. ..... 84/723; 84/422.1
(58) Field of Search ..... 84/422.1, 422.2, 84/422.3, 723, 746, 730, 721; 200/86.5

(56) References Cited

U.S. PATENT DOCUMENTS

| | | | | |
|---|---|---|---|---|
| 1,176,943 A | | 3/1916 | BOllinger | |
| 3,677,126 A | * | 7/1972 | Simpson | 84/422.1 |
| 4,141,273 A | * | 2/1979 | Austin | 84/484 |
| 4,200,025 A | | 4/1980 | Currier | |
| 4,491,050 A | * | 1/1985 | Franzmann | 84/746 |
| 4,744,279 A | | 5/1988 | Livingston | |
| 4,817,485 A | | 4/1989 | Bozzio et al. | |
| 4,819,536 A | | 4/1989 | Lombardi | |
| 2002/0056357 A1 | | 5/2002 | Kassabian | |
| 2002/0152872 A1 | * | 10/2002 | O'Donnell | 84/422.1 |

OTHER PUBLICATIONS

Internet web page: www.hartdynamics.com/products/adt/index.html dated Jun. 13, 2003 (3 sheets).
Internet web page: www.hartdynamics.com/faq/index.html dated Jun. 13, 2003 (2 sheets).

* cited by examiner

*Primary Examiner*—Marlon T. Fletcher
*Assistant Examiner*—David S. Warren
(74) *Attorney, Agent, or Firm*—Polster, Lieder, Woodruff & Lucchesi, L.C.

(57) ABSTRACT

A bass drum foot pedal assembly for triggering rapid multiple drum beats in an electronic drum or percussion synthesizer having a frame with an upper striking surface with an electronic drum trigger wired to the electronic drum and a lower striking surface with an electronic drum trigger wired to the drum, a spring-biased foot pedal having a contact on the upper surface of the pedal toe and a contact on the lower surface of the pedal toe positioned between the upper and lower striking surfaces. The drummer can trigger a drumbeat upon depression of the pedal by causing the lower contact to actuate a trigger and by releasing the pedal to the upper contact to actuate a trigger, thereby triggering multiple rapid drumbeats.

26 Claims, 3 Drawing Sheets

MULTI-TRIGGER ELECTRONIC DRUM PEDAL

CROSS-REFERENCE TO RELATED APPLICATIONS

This application claims priority to provisional application Ser. No. 60/393,625, filed Jul. 2, 2002

BACKGROUND OF THE INVENTION

The invention relates generally to percussion instruments and, more specifically, to a foot actuated bass drum pedal that allows the drummer to perform rapid, multiple drumbeats on a percussion instrument synthesizer or an electronic drum set.

Drummers always are seeking ways to effectuate rapid drum beats, particularly on a base drum. Generally, the drummer causes a bass drum beat by depressing a floor mounted drum foot pedal, which causes a pivotally mounted drumbeater to strike the base drum. With electronic percussion instruments such as electronic drums or synthesizers the drumbeat generally is actuated by closing an electronic contact or actuating a vibration detecting transducer, which then electronically elicits a drumbeat. Synthesized percussion instruments and representative prior art embodiments of drum pedals used therewith are described in U.S. Pat. No. 4,200,025, U.S. Pat. No. 4,744,279 and U.S. Pat. No. 4,817,485.

Prior art devices suffer from notable drawbacks, particularly that drummer foot speed limits the rapidity of generating a drumbeat. It would be advantageous, therefore, to have a drum pedal assembly that can actuate rapid, multiple drum beats with little additional effort or foot speed by the drummer.

SUMMARY OF THE INVENTION

It is among the several objects of the invention to provide a foot actuated drum pedal for an electronic drum set wherein the pedal actuates a bass drum beat both when depressing the pedal and when releasing the pedal. The drum pedal allows the drummer to generate rapid, multiple drumbeats with little additional physical exertion.

Generally stated, the electronic drum pedal assembly of the present invention includes a base, a heel plate on the base at the heel end of the base and foot pedal pivotally attached to the heel plate. There is a biasing spring between the foot pedal and the base. The foot pedal includes an upwardly extending striker at the toe end and a downwardly extending striker also at the toe end of the foot pedal. An upper striking surface is adjustably positioned above the toe end of the foot at a desired height and a lower striking surface is mounted on the base below the toe end of the foot pedal. In a preferred embodiment, the respective striking surfaces are rectangular, hollow tubes. A first transducer is acoustically attached to the upper striking surface and a second transducer is acoustically attached to the lower striking surface. In a preferred embodiment, the respective transducers are of the piezoelectric type that can convert impact-induced vibration into an electrical signal into an electrical output signal. The transducers are electrically connected to plugs or jacks. Leads from the electronic drum or synthesizer are operatively connected to the jacks.

Depression of the spring-biased pivotal foot pedal causes the lower striker to impact the lower striking surface, causing vibration, which generates an electrical signal through the transducer to the drum, and release of the foot pedal allows the upper striker to impact the upper striking surface, causing vibration and generating an electrical signal through the transducer to the drum. Thus, the drummer can generate a drum beat by alternatively depressing and releasing the foot pedal, which allows the drummer to generate rapid, multiple drumbeats with little additional physical exertion or added foot speed.

The adjustability of the top striking surface allows the drummer to increase or decrease the distance between the upper and lower striking surface, thus permitting the drummer to adjust pedal travel, to alter the rapidity of drumbeats or adjust the general feel of the drum pedal to taste and style.

In another embodiment, the upper and lower strikers and striking surfaces can be electrical contacts wherein striking of a striking by the contact closes an electrical circuit to generate an electrical signal to the drum to elicit a drumbeat. The drummer similarly can generate rapid, multiple drumbeats through pedal depression and pedal release.

DESCRIPTION OF THE PREFERRED EMBODIMENT

Figure 1:
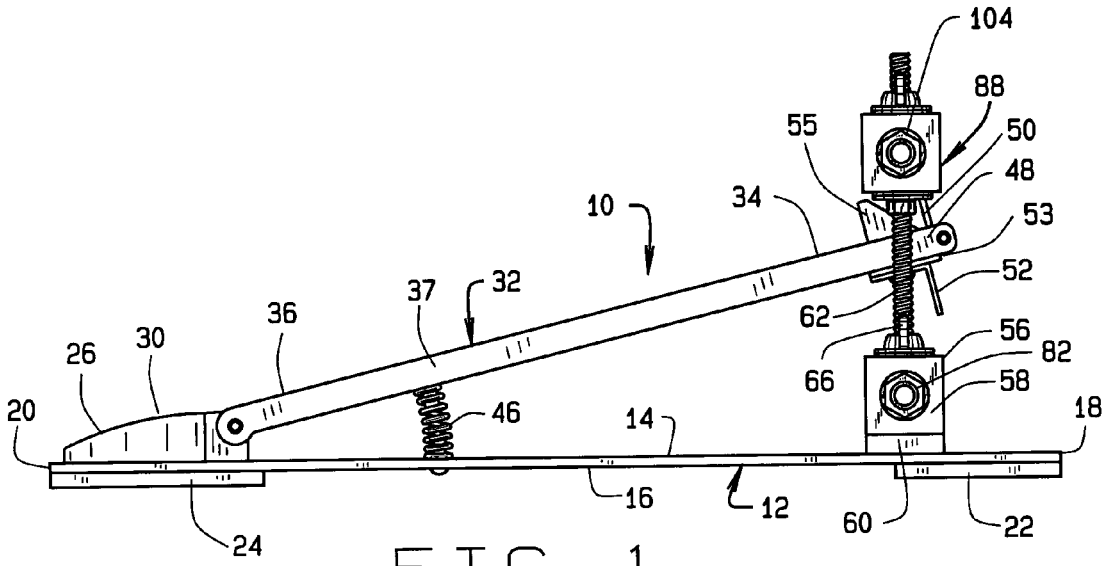
FIG. 1 is a side elevational view of the multi-trigger drum pedal assembly of the present invention.
Figure 2:
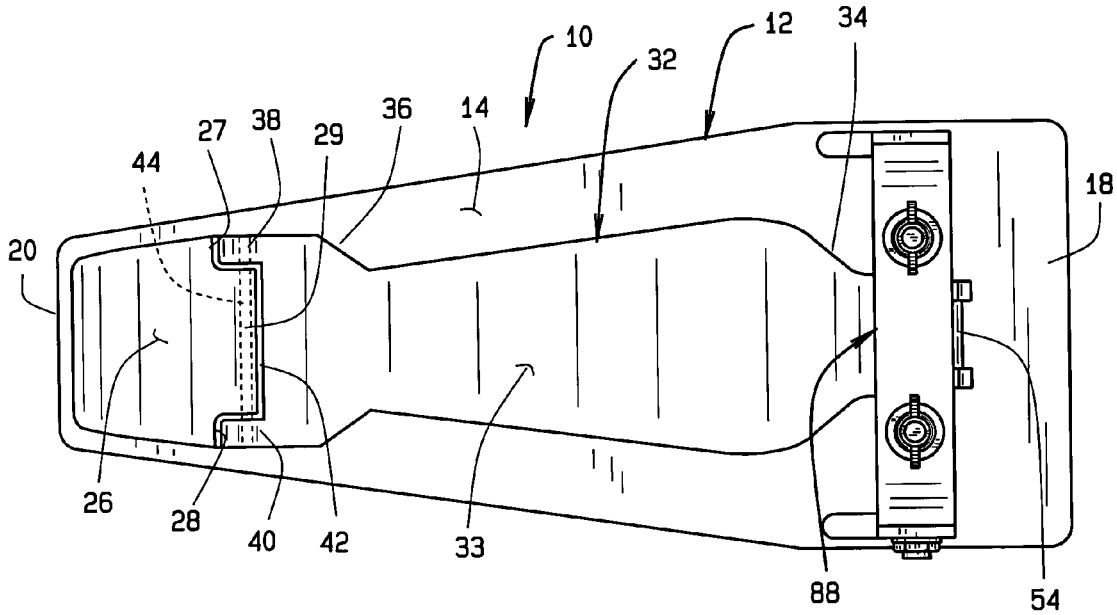
FIG. 2 is a top plan view of the drum pedal assembly.

One embodiment of the multi-triggered drum pedal assembly of the present invention is shown in FIGS. 1–4 and indicated generally by reference numeral 10. Drum pedal assembly 10 includes a base 12 having a top surface 14 and a bottom surface 16. The base 12 generally is a flat plate, fashioned from a durable, lightweight material, such as aluminum, or any other wear-resistant material. Base 12 is designed to rest on a playing surface, such as the floor. Base 12 has a toe end 18 and a heel end 20. As shown, the toe end 18 is wider than the heel end 20 to provide a stable, yet aesthetically pleasing base. There is a traction pad 22 attached to the bottom surface 16 at the toe end 18 of the base plate and a second traction pad 24 attached to the bottom surface 16 at the heel of the base. The traction pads generally are fashioned from rubber and have transverse ridges to improve the non-skid characteristics of the pads. The pads keep the pedal assembly 10 from slipping or skidding on the floor when the pedal is in use. Also, the pads prevent the metal base from directly contacting the floor and provide some shock absorption properties. Any number of traction pads may be employed, or the entire bottom surface 16 of the base plate can be covered with a cushioning, non-skid material, if desired.

There is a heel pad 26 mounted on base plate at the heel end of the plate, generally by screws that extend upwardly through the base and the traction pad to engage the heel pad. Heel pad 26 has a generally rectangular outline, being somewhat wider at the front edge than at the rear in the illustrated embodiment. Heel pad 26 has recessed corners 27 and 28 on the front edge with a hinge-mounting boss 29 extending out between the recesses. As shown in FIG. 1, heel plate 26 has a slightly rounded profile created by a rearward sloping top surface 30. The drummer's heel generally rests on heel plate 26 during play and the sloped top surface facilitates the rocking of the drummer's foot to depress the foot pedal.

A foot pedal 32 is attached to the heel pad and positioned above the base. Foot pedal 32 has an elongated, flat body section 33, a toe end 34 and a heel end 36. In the embodiment shown, body section 33 tapers in width from the toe toward the heel, but flares out at each side of the heel end. The top surface of the pedal can include a traction pad, strips or grooves that retard slippage of the drummer's foot. The flared heel end includes a pair spaced apart lugs 38, 40 with a notch or space 42 in between. Space 42 is dimensioned so that hinge mounting boss 29 fits within space 42. A hinge pin 44 extends through lugs 38 and 40, as well as boss 29 so that pedal 32 is hingedly or pivotally attached to heel pad 26.

As seen in FIG. 1 there is a spring 46 between base 12 and pedal 32 to bias pedal 32 away from the base. Although shown as a coil spring, a leaf spring, a resilient material, such as rubber, or other biasing elements can be used to bias the pedal above the base. In any event, the tension of the biasing means, such as spring 46 can be varied, again to adjust the feel of the pedal to the drummer's tastes. That is, for example, a coil spring that is easier or more difficult to compress can be used in that position, as the drummer desires.

Figure 3:
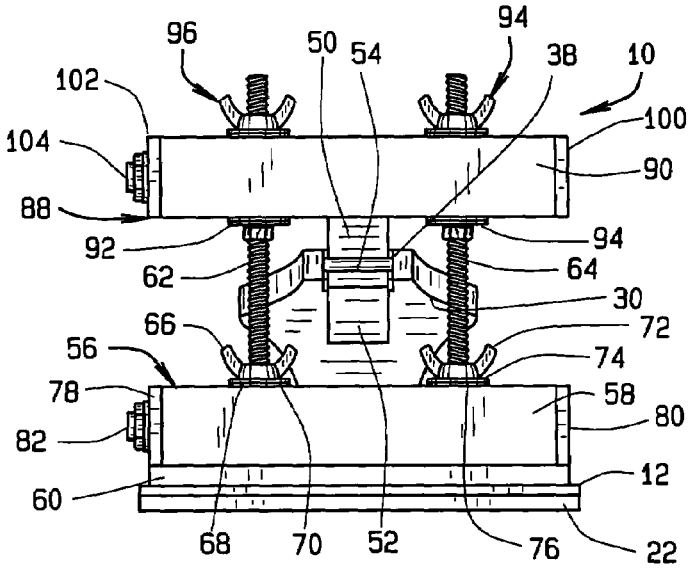
FIG. 3 is an end plan view thereof with the drum pedal striker contacting the upper striking surface.

There is a striker mounting extension 48 at the extreme toe end of pedal 32. In the illustrated embodiment, the extension 48 is narrower in width that the pedal but generally of the same thickness. There us an upper striker 50 extending upwardly from the top surface of the extension and a lower striker 52 extending downwardly from the bottom surface of the extension. In the preferred embodiment, the respective strikers are formed in an L-shape from flat metal sheets seated in a recess 53 in extension 48 and attached to the pedal by screws. As seen in FIG. 3, a bar 54 extends across the recess to close of the recess and provide a pleasing, finished look. There is a wedge-shaped toe stop 55 extending upwardly from boss 48 between the boss and body 33 of the pedal. Toe stop 55 provides a forward contact point for the drummer's foot to prevent the foot from sliding too far forward and to give the drummer a landmark when feeling for the pedal.

It will be noted that although the respective strikers 50,52 are shown as a formed from flat sheet metal, the strikers can be of any configuration and of any appropriate material. The only requirement for construction of the strikers is that they be of an appropriate material and configuration so as to cause vibration in a striking surface when they contact the striking surface, as will be explained below. Furthermore, these elements are referred to as strikers for simplicity and clarity. The also could be referred to as striking elements or hammers or other such appropriate term.

Figure 4:
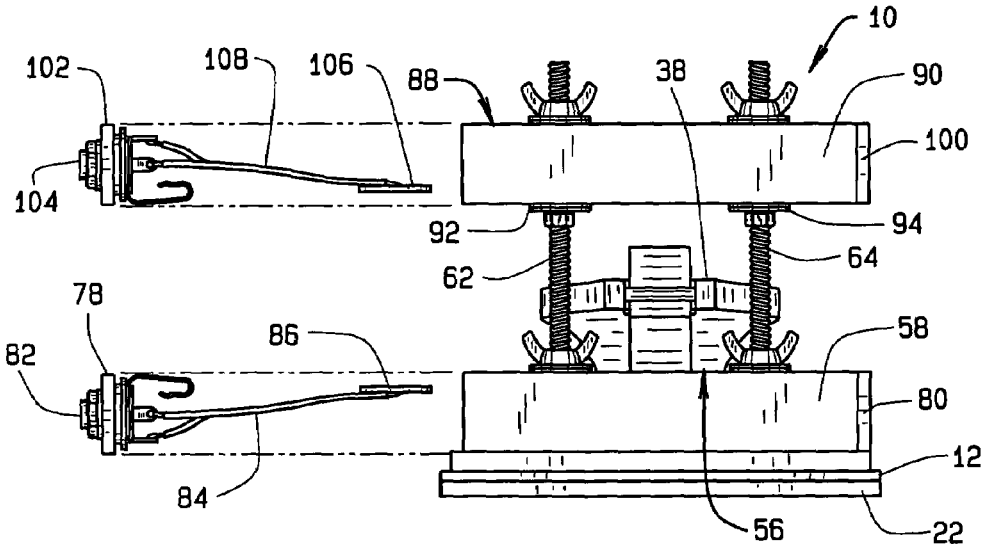
FIG. 4 is another end plan view with the drum pedal striker contacting the lower striking surface, partially exploded to illustrate the vibration detecting transducers.

A lower striking surface 56 is mounted on the base, toward the toe end, and positioned under pedal 32 so that the lower striker 52 contacts the striking surface when the drummer depresses pedal 32, as illustrated in FIG. 4. In the preferred embodiment, the lower striking surface 56 is constructed from a rectangular tube 58, generally a metal tube, such as an aluminum tube. Tube 58 is positioned transversely on base 12. There is a shock absorber 60, generally foam rubber, between the bottom surface of tube 58 and base 12. Tube 58 is attached to the base by threaded rods 62 and 64. The threaded rods extend through holes (not seen) in the top and bottom surfaces of the tube, the shock absorber, through the base and traction pad, and are secured to the base by nuts (not seen) at the bottom of the base. The hex-nuts generally are recessed in the traction pad. A wing nut 66, metal washer 68 and shock absorbing rubber washer 70 on threaded rod 62 and a wing nut 72, metal washer 74 shock absorbing waster 76, are tightened against tube 58 to secure it in place on base 12 with shock absorber 60 sandwiched in-between. In the preferred embodiment, wing nuts are used to facilitate easy removal of the rods and tube in the event the drummer desires to adjust the positioning of tube 58. For example, tube 58 can be raised to reduce travel of pedal 32 by inserting a thicker shock absorber, bushings, support blocks or springs under tube 58. For all practical purposes, tube 58, therefore, can be considered adjustable.

As seen in FIG. 4, there are plastic plugs 78 and 80 inserted into each end of tube 58. However, as seen in FIG. 1, plug 78 includes a jack 82 for insertion of an appropriate lead from the electronic drum set, as known in the art. Jack 82 is electrically connected by wires 84 to a trigger 86. The trigger can be a transducer of the piezoelectric type that converts impact-induced vibration into an electrical signal into an electrical output signal. In the preferred embodiment, trigger 86 is attached or bonded to the top surface of tube 58 inside the tube, generally at the middle of the tube, by appropriate means, such as liquid silicone that dries to hold trigger 86 in place, similar to gluing. Trigger 86 is a transducer that picks up vibrations when lower striker 52 strikes striking surface 56 and transmit that information or voltage to the synthesizer. Although the illustrated embodiment shows one trigger positioned centrally inside tube 58, more than one trigger can be employed in a striking element, to increase sensitivity or to trigger multiple drums. One example of such an arrangement would be two triggers, one at each end of the tube.

A second, upper striking surface 88 is positioned above pedal 32 so that upper striker 50 can contact the striking surface when pedal 32 is released and the spring forces it upward, as seen in FIG. 3. Striking surface 88, in the illustrated embodiment, comprises a rectangular tube 90. Tube 90 is mounted on threaded rods 62 and 64, which extend through the tube. A pair of nut and washer combinations 92, 94 are positioned under the tube and a pair of wing nuts 96, 98 and washer and shock absorbing washers are positioned on top of tube 90 to secure in place on the threaded rods. The ends of tube 90 are closed with plugs 100 and 102, with plug 100 including jack 104 that is electrically connected to trigger 106 by wires 108. Trigger 106 is of the same type as trigger 86 and mounted inside tube 90 in a similar fashion. And, likewise, more than one trigger may be employed in tube 90.

It will be understood, that the various nut and washer combinations can be used to adjust the relative position of tube 90 to pedal 32 and tube 58. That is, tube 90 can be raised or lowered on the threaded rods to increase or decrease pedal travel so as to adjust the pedal to the drummer's taste or musical style.

Figure 5:
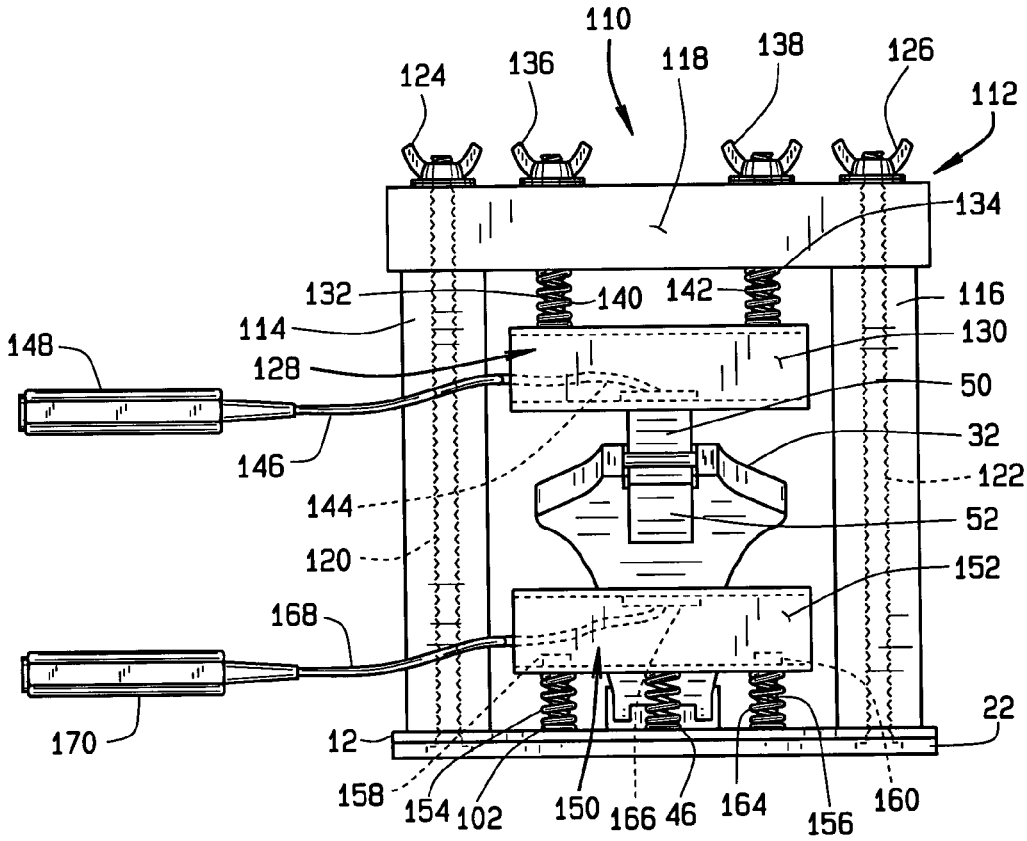
FIG. 5 is another embodiment of the multi-triggered drum pedal assembly of the present invention.

FIG. 5 shows an alternative embodiment of the drum pedal assembly, indicated generally by reference numeral 110. In general, the base 12 and pedal arrangement are the same as that of pedal assembly 10, including an upwardly extending striker 50 and a downwardly extending striker 52. However, pedal assembly 110 includes an upper striking surface support frame 112 including first vertical support 114 and a spaced apart second vertical support 116. The respective supports are positioned at the extreme lateral edges of base 12, adjacent the toe end of the base. There is a cross member 118 bridging the two vertical supports. In the illustrated embodiment, the vertical supports and cross member are rectangular tubes, however, any appropriate configuration is acceptable. As shown, cross member 118 is attached to the vertical supports by a threaded rods 120 and 122 that extend through holes formed in the cross member walls (not shown) and fastened under base 12 by hex-nuts (not shown). Wing nut and washer assemblies 124 and 126 secure the cross member to the vertical supports.

An upper striking surface 128 is suspended below cross member 118. In the illustrated embodiment, striking surface 128 comprises a rectangular metal tube 130. Tube 130 is connected to cross member 118 by a pair of shorter threaded rods 132 and 134 which extend through cross member 118. The upper ends of threaded rods 132, 134 are secured to cross member 118 by wing nut 136 and 138, generally with washers, respectively and to tube 130 by hex nuts (not shown) on the bottom side of tube 130. It will be noted that there is a coil spring 140 around rod 132 and a coil spring 142 around rod 134. Tube 130 can be raised or lower vis-à-vis pedal 32 by adjusting wing nuts 136 and 138. Springs 140 and 142 provide stability and shock absorbing characteristics. A trigger 144, of the type previously described, is bonded to the lower inside surface of tube 130 and connected by wires 146 to a jack plug 148.

A lower striking surface 150 is positioned below striker 52. In the illustrated embodiment, lower striking surface 144 comprises a rectangular metal tube 152. Tube 152 is positioned above base 12 and supported by short threaded rods 154 and 156, which extend through holes in the bottom surface of tube 152 and secured to the tube by hex-nuts 158, 160 respectively. The hex-nuts are recessed into traction pad 22. Rods 154 and 156 are secured to base 12 by hex nuts (not shown) on the bottom of the base. There is a coil spring 162 around rod 154 and a coil spring 164 around rod 156 to maintain tube 152 above base 32 and to provide stability and shock absorbing characteristics. A trigger 166 is bonded to the inside of the upper surface of tube 152 and connected by wires 168 to jack plug 170.

Pedal assembly 110 functions similarly to pedal assembly 10. When the drummer depresses pedal 32, striker 52 contacts lower striking surface 150. The vibration is sensed by trigger 166, which is connected to the synthesizer through leads connected to jack plug 164 to elicit a drumbeat. When the drummer releases pedal 32, striker 50 contacts upper striking surface 128, which, in turn, actuates a drumbeat through trigger 144. The drummer can adjust the travel of pedal 32 by lowering or raising striking surface 128 or striking surface 150. The presence of coil springs 140,142 and 162, 164 provide shock-absorbing characteristics that give the drummer better control over the instrument.

In alternative embodiments of either pedal assembly 10 or 110, the upper and lower strikers and the upper and lower striking surfaces are electrically connected to the synthesizer so that the closing of a circuit generates the drum beat. That is, the strikers and striking surfaces are electrical contacts. When the upper striker contacts the upper striking surface, a circuit is closed, eliciting a drumbeat. Likewise, the same occurs when the lower striker contacts the lower striking surface. Instead of a vibration eliciting the drumbeat, a direct current does so. In any event, the positioning of the striking surfaces and strikers result in the rapid drum beat.

It will be appreciated that the striking surfaces 56 and 88 and 128 and 150 in the illustrated embodiments are rectangular hollow metal tubes. This construction imparts desired vibratory qualities to the striking surfaces, which in turn, provide desired sensitivity and responsiveness. However, it will be understood that the term striking surface, as used, is intended to include any striking surface equipped with a transducer, that can be contacted or struck by the pedal to elicit a vibration and, hence, a drumbeat. The striking surfaces may be flat, rather than tubular, cylindrical or any other configuration that will allow the attachment of a trigger or electrical contact, without departing from the scope of the invention. The striking surfaces also may be referred to as anvils, impact surfaces or the like.

It will be appreciated by those skilled in the art that changes and modifications may be made in the specific embodiments without departing from the scope of the invention. The foregoing description and accompanying drawings disclose the best mode of working the invention presently known to the inventor and are intended to be illustrative of the broad invention. Therefore, the specification should be viewed as illustrative and should not be construed as limiting the scope of the appended claims.

What is claimed is:

1. A drum pedal assembly for effecting rapid, multiple drumbeats from an electronic drum, comprising:

a base plate;

a foot pedal pivotally connected to the base plate, said foot pedal having a top surface and a bottom surface;

a first striker extending below lower surface of the foot pedal;

a second striker extending above the upper surface of the foot pedal;

a first striking surface below the first striker;

a second striking surface above the second striker;

a first transducer for converting an impact induced vibration into an electrical output signal operatively associated with the first striking surface and operatively connected to the electronic drum and a second transducer for converting an impact induced vibration into an electrical output signal operatively associated with the second striking surface and operatively connected to the electronic drum, each said transducer, wherein depression of the foot pedal by a user causes the first striker to contact the first striking surface to generate an electrical output signal to the drum and release of the foot pedal allows the second striker to contact the second striking surface to generate an electrical output signal to the drum.

2. The drum pedal assembly of claim 1 comprising a biasing element between the base and the pedal.

3. The drum pedal assembly of claim 1 wherein the upper striking surface is a tubular element.

4. The drum pedal assembly of claim 1 wherein the lower striking surface is a tubular element.

5. The drum pedal assembly of claim 3 wherein the second transducer is acoustically connected the tubular element.

6. The drum pedal assembly of claim 4 wherein the first transducer is acoustically connected to the tubular element.

7. The drum pedal assembly of claim 1 wherein the biasing element is a coil spring.

8. The drum pedal assembly of claim 1 further comprising a heel pad affixed to the base, said foot pedal being pivotally connected to said heel pad.

9. The drum pedal assembly of claim 1 wherein said upper striking surface is adjustable whereby a user can adjust a distance between the upper striking surface and the lower striking surface.

10. The drum pedal assembly of claim 1 wherein the foot pedal further comprises a toe stop at a toe end of the foot pedal.

11. The drum pedal assembly of claim 9 further comprising a first vertical support element extending between the base and the upper striking surface and a second vertical support element extending between the base and the upper striking surface, said upper striking surface being adjustable along the vertical dimension of the recited vertical support elements.

12. The drum pedal assembly of claim 11 wherein said first vertical support element and said second vertical support element comprise threaded rods.

13. The drum pedal assembly of claim 12 wherein said upper striking surface is releasably secured to said first and second vertical support elements by a first and second releasable nut assembly.

14. The drum pedal assembly of claim 1 further comprising a shock-absorbing element between the lower striking surface and the base.

15. The drum pedal assembly of claim 1 wherein said first and second transducers is operatively connected to a jack plug.

16. The drum pedal assembly of claim 12 wherein said lower striking surface is adjustable connected to the first and second vertical supports.

17. A drum pedal assembly for use by a drummer to effect drumbeats from an electronic percussion instrument, comprising:

a base for resting on a surface;

a heel pad affixed to the base;

a foot pedal having a toe end and a heel end, said heel end pivotally connected to the heel pad, said toe end including a upper striker and a lower striker;

a biasing element between the pedal and the base;

an upper striking surface positioned above the upper striker, said upper striking surface having a vibration detecting transducer associated therewith;

a lower striking surface spaced apart from the upper striking surface and positioned below the lower striker, said lower striking surface having a vibration detecting transducer y associated therewith;

said recited transducers being operatively connected to the electronic percussion instrument where by contact by the upper and lower strikers with the upper and lower striking surfaces elicits a drumbeat from the electronic percussion instrument.

18. The drum pedal assembly of claim 17 wherein said upper striking surface comprises a tube.

19. The drum pedal assembly of claim 17 wherein said lower striking surface comprises a tube.

20. The drum pedal assembly of claim 18 wherein said tube is rectangular in cross section.

21. The drum pedal assembly of claim 19 wherein said tube is rectangular in cross section.

22. The drum pedal assembly of claim 17 further comprising a shock absorber between the lower striking surface and the base.

23. The drum pedal assembly of claim 17 wherein the space between the upper striking surface and the lower striking surface is adjustable.

24. A multi-trigger drum pedal assembly for use with an electronic percussion instrument, comprising:

a base for resting engagement on a playing surface, the base having a toe end and a heel end;

a heel pad affixed to the heel end of the base;

a striking surface assembly at the toe end of the base, said striking surface assembly comprising a lower striking surface adjacent the base, a first vertical support having a upper end and a lower end attached to the base, a second vertical support having an upper end and a lower end attached to the base, an upper striking surface attached between the upper end of the first vertical support and the upper end of the second vertical support;

a first electronic percussion instrument actuation trigger operatively attached between the electronic percussion instrument and the upper striking surface and a second electronic percussion instrument actuation trigger operatively attached between the electronic percussion instrument and the lower striking surface a foot pedal having a toe end and a heel end, said foot pedal being pivotally attached to the heel pad at its heel end with the toe end of the foot pedal positioned between the upper striking surface and the lower striking surface;

a biasing element between the foot pedal and the base;

a striker assembly on the toe end of the foot pedal including an upper striker element and a lower striker element and positioned so that depression of the foot pedal against the biasing element causes the lower striker element to contact the lower striking surface and release of the foot pedal permits the foot pedal to lift causing the upper striker element to contact the upper striking element, wherein contact by the first striker with the first striking surface generates an electrical output signal from the first trigger to the electronic percussion synthesizer and contact by the second striker with the second striking surface to generate an electrical output signal from the second trigger to the electronic percussion synthesizer, said output signals generating a drum beat.

25. A drum pedal assembly for use by a drummer to effect multiple, rapid drumbeats from an electronic percussion instrument, comprising:

a base for resting on a playing surface, said base having a toe end and a heel end;

a heel pad affixed to the base at the heel end;

a foot pedal having a toe end and a heel end, said heel end pivotally connected to the heel pad, said toe end including an upwardly disposed striker and a downwardly disposed striker;

a biasing spring between the pedal and the base to bias said pedal away from said base;

an upper striking tube positioned above the upwardly disposed striker, said upper striking tube having a transducer mounted inside;

a lower striking tube on the base and positioned below the downwardly disposed striker, said lower striking tube having a transducer mounted inside, said upper striking tube and said lower striking tube defining a drum pedal travel space in-between;

said recited transducers being operatively connected to the electronic percussion instrument whereby by contact by the recited strikers with the recited striking surfaces elicits a drumbeat from the electronic percussion instrument through the recited transducers.

26. The drum pedal assembly of claim 25 further comprising an adjustment assembly between the upper striking tube and the base, whereby the drum pedal travel space between the upper striking tube and lower striking tube can be adjusted.

* * * * *